US005632155A

United States Patent [19]

Sugiyama et al.

[11] Patent Number: 5,632,155

[45] Date of Patent: May 27, 1997

[54] AIR-CONDITIONING APPARATUS WITH AN INDOOR UNIT INCORPORATING A COMPRESSOR

[75] Inventors: Akihiko Sugiyama, Fuji; Hidenori Ashikawa, Yokohama; Hitoshi Wakatsuki, Numazu; Kimithuka Ueda, Fuji, all of Japan

[73] Assignee: Kabushiki Kaisha Toshiba, Kawasaki, Japan

[21] Appl. No.: 536,527

[22] Filed: Sep. 29, 1995

[30] Foreign Application Priority Data

Mar. 31, 1995 [JP] Japan ..... 7-076289

[51] Int. Cl.[6] ..... F24F 11/02

[52] U.S. Cl. ..... 62/179; 62/298; 62/277

[58] Field of Search ..... 62/160, 448, 298, 62/324.1, 324.6, 277, 278, 180, 179; 307/11, 17, 42

[56] References Cited

U.S. PATENT DOCUMENTS 3,004,399 10/1961 Keller ..... 62/160 X
4,104,890 8/1978 Iwasaki ..... 62/324
4,228,846 10/1980 Smorol ..... 62/160 X
4,763,485 8/1988 Sparks ..... 62/298 X
5,352,930 10/1994 Ratz ..... 307/17 X

FOREIGN PATENT DOCUMENTS 60-235938 11/1985 Japan .

*Primary Examiner*—Harry B. Tanner
*Attorney, Agent, or Firm*—Cushman Darby & Cushman, IP Group of Pillsbury Madison & Sutro, LLP

[57] ABSTRACT

An air conditioner having an indoor unit and an outdoor unit. The indoor unit has a compressor, an indoor heat exchanger, and a indoor fan. The outdoor unit has an outdoor heat exchanger, a capillary tube, and an outdoor fan. In use, the indoor unit is connected to a commercial AC power supply. A driving circuit is provided in the indoor unit, for applying a voltage via a power-supply line to the outdoor unit to drive the outdoor fan. This voltage is lower than the voltage of the commercial AC power supply. Thus, the power-supply line can be connected to the indoor and outdoor units, with ease and in safety.

8 Claims, 4 Drawing Sheets

AIR-CONDITIONING APPARATUS WITH AN INDOOR UNIT INCORPORATING A COMPRESSOR

BACKGROUND OF THE INVENTION

1. Field of the Invention

The present invention relates to an air-conditioning apparatus which comprises an indoor unit, an outdoor unit, and a compressor incorporated in the indoor unit.

2. Description of the Related Art

An air conditioner has a refrigerating cycle. The refrigerating cycle comprises a compressor, a four-way valve, an outdoor heat exchanger, an expansion device, and an indoor heat exchanger, which are connected by pipes.

To cool a room, the refrigerant supplied from the compressor is passed through the four-way valve, the outdoor heat exchanger, the expansion device and the indoor heat exchanger in the order mentioned, and is fed back into the compressor via the four-way valve. To warm the room, the refrigerant supplied from the compressor is passed through the four-way valve, the indoor heat exchanger, the expansion device and the outdoor heat exchanger, and is fed back into the compressor via the four-way valve.

Generally, the compressor, the four-way valve, the outdoor heat exchanger, the expansion device, and the outdoor fan are incorporated in an outdoor unit, while the indoor heat exchanger and the indoor fan are incorporated in an indoor unit.

Recently a new type of an air conditioner has been developed in which the compressor and the four-way valve are provided in the indoor unit. Incorporating neither a compressor nor a compressor-driving circuit, the outdoor unit can be small. The electric parts in the indoor unit, such as those of the power-supply circuit, can be used to drive the compressor as well, the indoor unit need not have additional electric parts for driving the compressor.

Usually, an air conditioner is installed by the technicians sent from the shop where the user has bought the air conditioner. This is because the indoor and outdoor units must be connected to the commercial AC power supply by high-voltage lines (100 V or more). From a safety point of view it is not recommendable that users should install the air conditioner unless they have been trained to do so.

Jpn. Pat. Appln. KOKAI Publication No. 60-235938 discloses an air conditioner in which the compressor is incorporated in the indoor unit. The indoor and outdoor units of this air conditioner are connected to two receptacles of commercial AC power supplies, respectively. The indoor unit and the outdoor unit are connected together by an AC control line.

SUMMARY OF THE INVENTION

The object of the present invention is to provide an air-conditioning apparatus which has a small outdoor unit and in which the indoor unit and the outdoor unit can be electrically connected with ease and in safety.

According to the present invention, there is provided an air-conditioning apparatus comprising: an outdoor unit having an outdoor heat exchanger, an expansion device, and an outdoor fan for circulating outdoor air via the outdoor heat exchanger; an indoor unit to be connected to a commercial AC power supply and having a compressor, an indoor heat exchanger, and an indoor fan circulating indoor air via the indoor heat exchanger; a driving circuit provided in the indoor unit, for applying a voltage lower than a voltage applied from the commercial AC power supply, to drive the outdoor fan; and a power-supply line for applying the output voltage of the driving circuit to the outdoor unit, wherein the compressor, the outdoor heat exchanger, the expansion device, and the indoor heat exchanger are connected by pipes, thereby constituting a refrigerating cycle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Embodiments of the present invention will now be described, with reference to the accompanying drawings.

Figure 2:
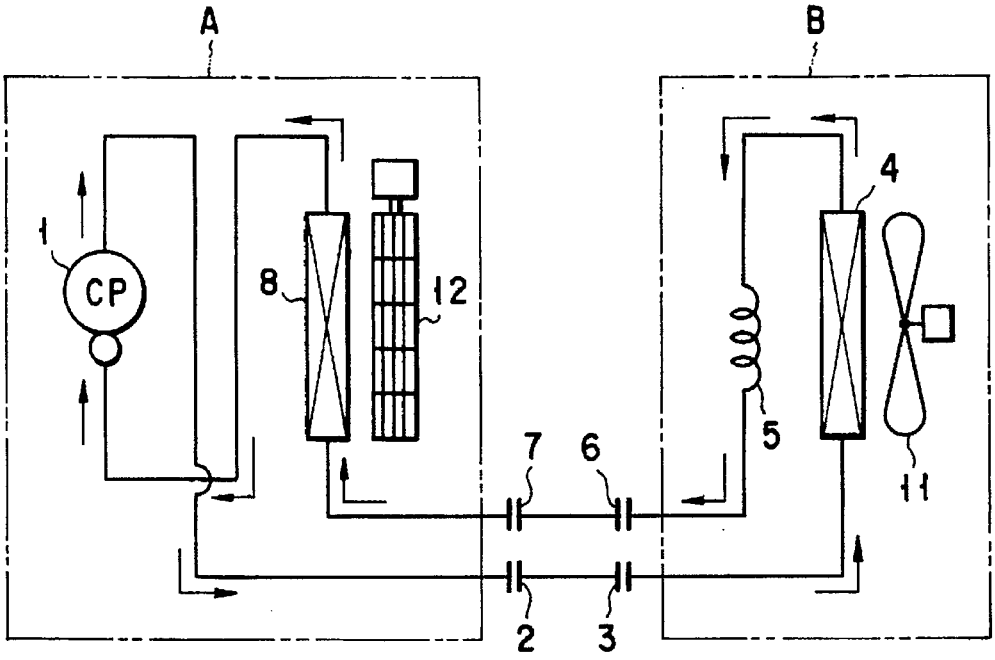
FIG. 2 is a diagram illustrating the refrigerating cycle provided in the first embodiment.

FIG. 2 shows an air conditioner according to the first embodiment of the invention. As shown in FIG. 2, the air conditioner comprises an indoor unit A, an outdoor unit B, and four connection valves 2, 3, 6 and 7. The indoor unit A has a variable-capacity compressor 1, an indoor heat exchanger 8 and an indoor fan 12. The outdoor unit B has an outdoor heat exchanger 4, an expansion device, for example, a capillary tube 5, and an outdoor fan 11.

The compressor 1 has a discharge port and a suction port. The discharge port is connected to one end of the outdoor heat exchanger 4 by a pipe, on which the connection valves 2 and 3 are mounted. The other end of the outdoor heat exchanger 4 is connected to one end of an indoor heat exchanger 8 by the capillary tube 5 and by a pipe on which the connection valves 6 and 7 are mounted. The other end of the indoor heat exchanger 8 is connected by a pipe to the suction port of the compressor 1. Thus, the compressor 1, the valves 2 and 3, the outdoor heat exchanger 4, the capillary tube 5, the connection valves 6 and 7, and the indoor heat exchanger 8, and the pipes constitute a refrigerating cycle.

The indoor unit A is installed in a room, and the outdoor unit B is installed outside the house. To cool the room, the compressor 1 discharges refrigerant, which flows to the outdoor heat exchanger 4 through the valves 2 and 3, hence to the indoor heat exchanger 8 through the capillary tube 5 and the valves 6 and 7, and is fed back to the compressor 1.

The outdoor fan 11 is located near the outdoor heat exchanger 4, to apply the outdoor air to the outdoor heat exchanger 4. Similarly, the indoor fan 12 is located near the indoor heat exchanger 8, to apply the indoor air to the indoor heat exchanger 8.

The air conditioner shown in FIG. 2 has a control circuit. The control circuit will be described, with reference to the block diagram of FIG. 1.

Figure 1:
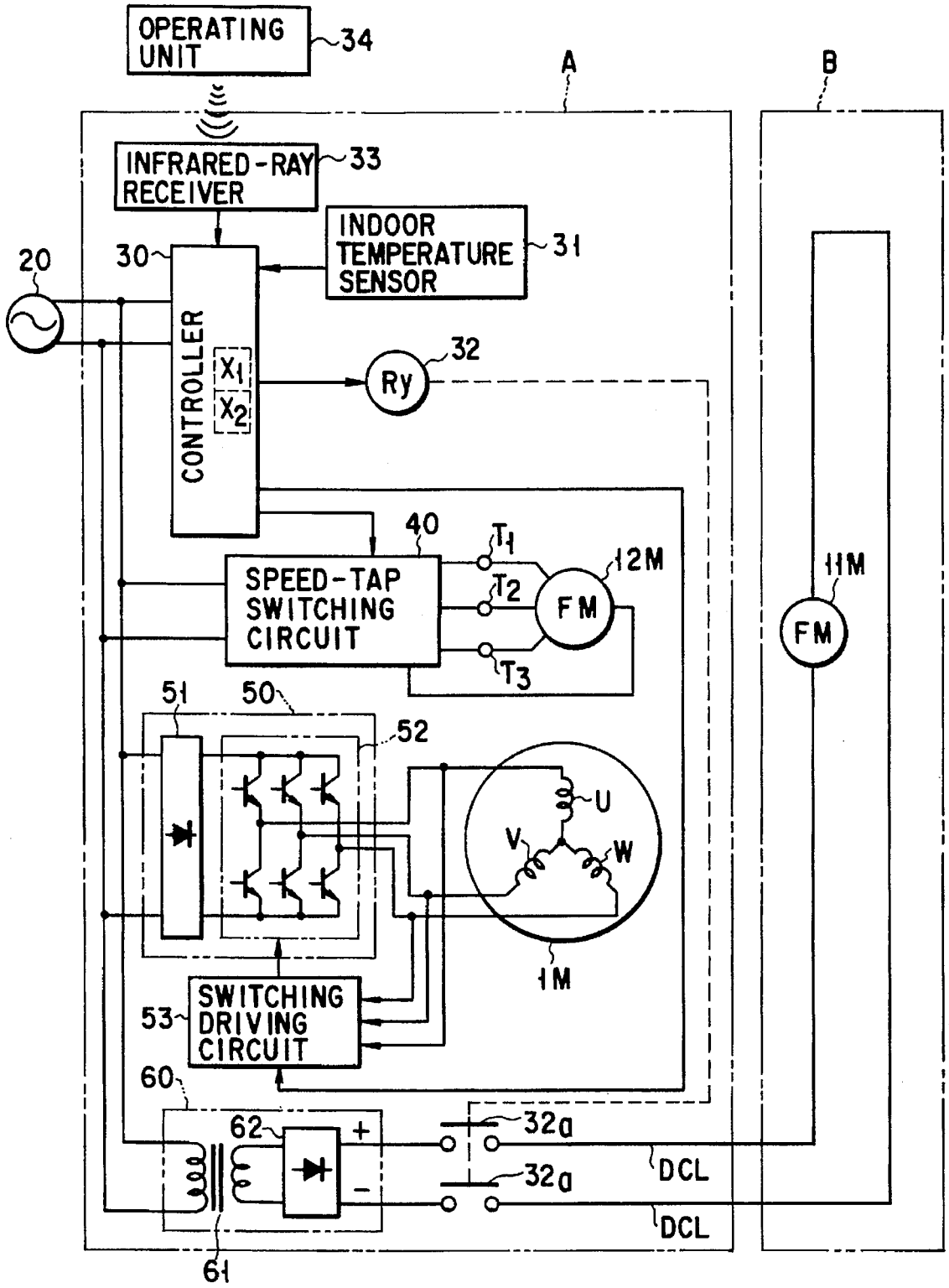
FIG. 1 is a block diagram showing the control circuit incorporated in an air conditioner which is a first embodiment of the invention.

As can be understood from FIG. 1, a controller 30, a speed-tap switching circuit 40, an inverter 50, and a driving circuit 60 are provided in the indoor unit A. These components 30, 40, 50 and 60 are connected to a commercial AC power supply 20.

The switching circuit 40 selects one of the three speed taps $T_1$, $T_2$ and $T_3$ of a motor 12 M (hereinafter called "indoor fan motor") incorporated in the indoor fan 12, in accordance with data supplied from the controller 30. When the circuit 40 selects the tap $T_1$, the indoor fan 12 will apply a strong air flow to the indoor heat exchanger 8. When the circuit 40 selects the tap $T_2$, the indoor fan 12 will apply a medium air flow to the indoor heat exchanger 8. When the circuit 40 selects the tap $T_3$, the indoor fan 12 will apply a weak air flow to the indoor heat exchanger 8.

The inverter 50 comprises a rectifier 51 and a switching circuit 52. The rectifier 51 rectifies the commercial AC voltage into a DC voltage, which is supplied to the switching circuit 52. The switching circuit 52 chops the DC voltage, thereby outputting a three-phase AC voltage at predetermined level and frequency. The three phase-components of the AC voltage are sequentially supplied to the three phase-windings U, V and W of the motor 1M (hereinafter called "compressor motor") provided in the compressor 1.

The compressor motor 1M is a brushless DC motor which comprises a rotor and a stator. The rotor has permanent magnets mounted on it, and the stator has the phase-windings U, V and W. The rotor rotates as the phase-components of the AC voltage are sequentially supplied to the windings U, V and W. The sequential application of the three phase-components of the AC voltage to the windings U, V and W, which is known as "commutation," is repeated to drive the compressor motor 1M continuously.

As shown in FIG. 1, a switching drive circuit 53 is connected to the inverter 50 and the compressor motor 1M. The circuit 53 adjusts the "on" period of the switching elements used in the switching circuit 52 by means of pulse-width modulation (PWM), in accordance with the motor-speed control signal supplied from the controller 30. The voltage applied to the phase-windings U, V and W of the motor 1M is thereby controlled to change the speed of the compressor motor 1M.

As seen from FIG. 1, the driving circuit 60 comprises a transformer 61 and a rectifier 62. The transformer 61 deceases the AC voltage applied from the AC power supply 20, to low AC voltage, which is applied to the rectifier 62. The rectifier 62 converts the low AC voltage to a DC voltage which is, for example, less than 42 V, i.e., a voltage less than half the commercial AC power-supply voltage.

A DC power-supply lines DCL is provided which consists of a positive line (+) and a negative line (−). The lines DCL are connected, at one end, to the output of the driving circuit 60, and at the other end, to the outdoor unit B. Thus, the DC power-supply lines DCL connects the indoor unit A to the outdoor unit B.

The controller 30 is designed to control the other components of the air conditioner. It has the following two main components:

(1) A cooling control unit $X_1$ in which the refrigerant discharged from the compressor 1 is supplied to the outdoor heat exchanger 4, the capillary tube 5 and the indoor heat exchanger 8, and is fed back to the compressor 1.

(2) A control unit $X_2$ which actuates a relay 32 (later described), thereby to supply an electric current to the motor 11M incorporated in the outdoor fan 11 (hereinafter called "outdoor fan motor") through the DC power-supply lines DCL.

Connected to the controller 30 are: the speed-tap switching circuit 40; switching drive circuit 53, an indoor-temperature sensor 31, the relay 32, and an infrared-ray receiver 33.

The indoor-temperature sensor 31 detects the temperature Ta in the room. The relay 32 controls the outdoor fan 11. The relay 32 has two normal-open contacts 32*a*, which are provided on the positive and negative lines of the lines DCL, respectively. The infrared-ray receiver 33 receives infrared rays emitted from a remote-control unit 34.

In the outdoor unit B, the outdoor fan motor 11M is connected to the DC power-supply lines DCL. The lines DCL are the sole component which electrically connects the indoor unit A and the outdoor unit B.

The operation of the air conditioner shown in FIGS. 1 and 2 will be described.

Assume that the user operates the remote-control unit 34, setting a cooling mode, a desired temperature Ts to which the room is to cooled and to start the air conditioner. If the temperature Ta in the room is higher than the desired temperature Ts, the inverter 50 is driven, driving the variable-volume compressor 1. The compressor 1 discharges the refrigerant, which first flows to the outdoor heat exchanger 4, then to the indoor heat exchanger 8 through the capillary tube 5, and finally back to the compressor 1.

The speed-tap switching circuit 40 selects one of the speed taps $T_1$, $T_2$ and $T_3$ of the indoor fan motor 12M in accordance with the user operating of the remote-control unit 34, the power-supply AC current is supplied to the selected speed tap of the motor 12M, and the indoor fan 12 is driven. If the user operates the remote-control unit 34, selecting high-speed air application, the power-supply AC current is supplied to the speed tap $T_1$, whereby the motor 12M is driven at high speed and a strong air flow is applied to the indoor heat exchanger 8. If the user's choice is medium-speed air application, the power-supply AC current is supplied to the speed tap $T_2$, whereby the motor 12M is driven at intermediate speed and a medium air flow is applied to the indoor heat exchanger 8. If the user's choice is weak-speed air application, the power-supply AC current is supplied to the speed tap $T_3$, whereby the motor 12M is driven at low speed and a weak air flow is applied to the indoor heat exchanger 8.

At this time, the relay 32 is driven, closing the normal-open contacts 32*a*. The low DC voltage output by the driving circuit 60 is thereby applied to the outdoor fan motor 11M through the DC power-supply lines DCL. Thus, the outdoor fan motor 11M is driven.

The outdoor heat exchanger 4 works as condenser, whereas the indoor heat exchanger 8 works as evaporator. The outdoor fan 11 applies an air flow to the outdoor heat exchanger 4, while the indoor fan 12 applies an air flow to the indoor heat exchanger 8. The air conditioner therefore starts operating in the cooling mode.

While the air conditioner is operating in cooling mode, the temperature Ta the indoor-temperature sensor 31 detects is compared with the desired temperature Ts preset, thereby obtaining the difference ΔT between the temperatures Ta and Ts. The temperature different ΔT thus obtained controls the output frequency of the inverter 50, i.e., the operating frequency F of the compressor 1. The compressor 1 is driven so as to lower the temperature Ta in the room to the desired temperature Ts.

When the user operates the remote-control unit 34 to stop the air conditioner or when the temperature Ta detected by the sensor 31 falls below the desired temperature Ts, the controller 30 supply a stop signal to the switching drive circuit 53. Upon receipt of the stop signal the circuit 53 stops the switching circuit 52 of the inverter 50. As a result, the compressor motor 1M is stopped. That is, the compressor 1 is stopped.

Since the compressor 1 and the driving circuit 60 for driving the outdoor fan motor 11M are provided in the indoor unit A, electric components such as a transformer need not be incorporated in the outdoor unit B. Hence, the outdoor unit B can be made smaller than otherwise.

Moreover, the DC power-supply lines DCL can be connected to the outdoor unit B and the indoor unit A in safety. This is because the voltage applied from the driving circuit 60 provided in the indoor unit A to the outdoor fan motor 11M provided in the outdoor unit B is less than half the commercial AC power-supply voltage. Thus, the air conditioner can be installed by the user even if he or she has not been trained to install air conditioners.

No other current than the current for driving the outdoor fan motor 11M flows through the DC power-supply lines DCL, and the current for driving the motor 11M is small. The lines DCL are therefore one which has a small diameter. Being thin, the lines DCL can easily be bent and twisted. This makes it easy to connect the indoor unit A and the outdoor unit B together.

Figure 3:
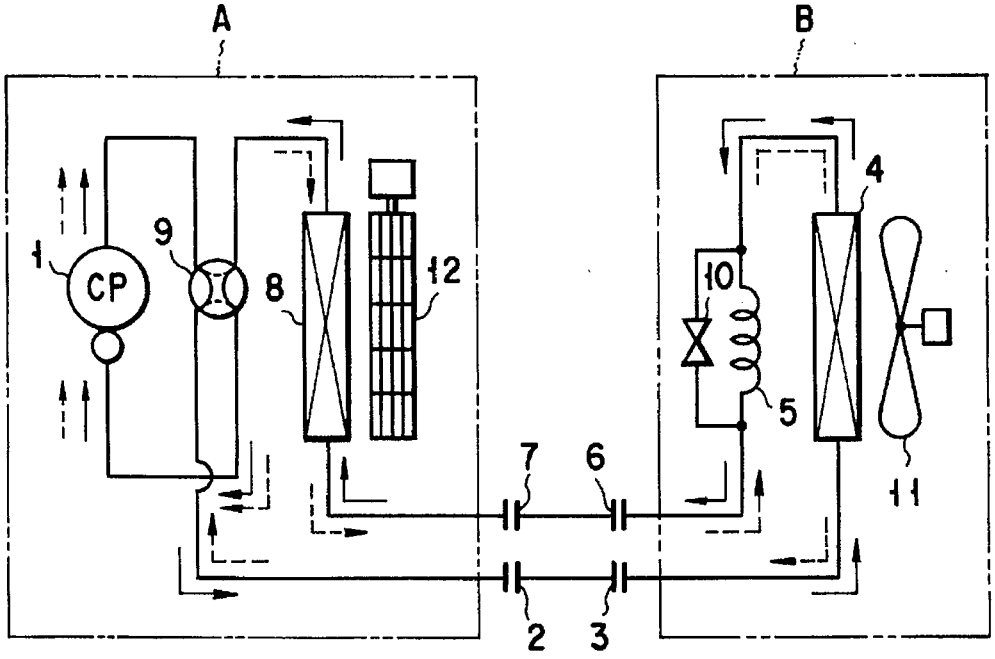
FIG. 3 is a diagram showing a refrigerating cycle for use in air conditioners which are second and third embodiments of the invention.
Figure 4:
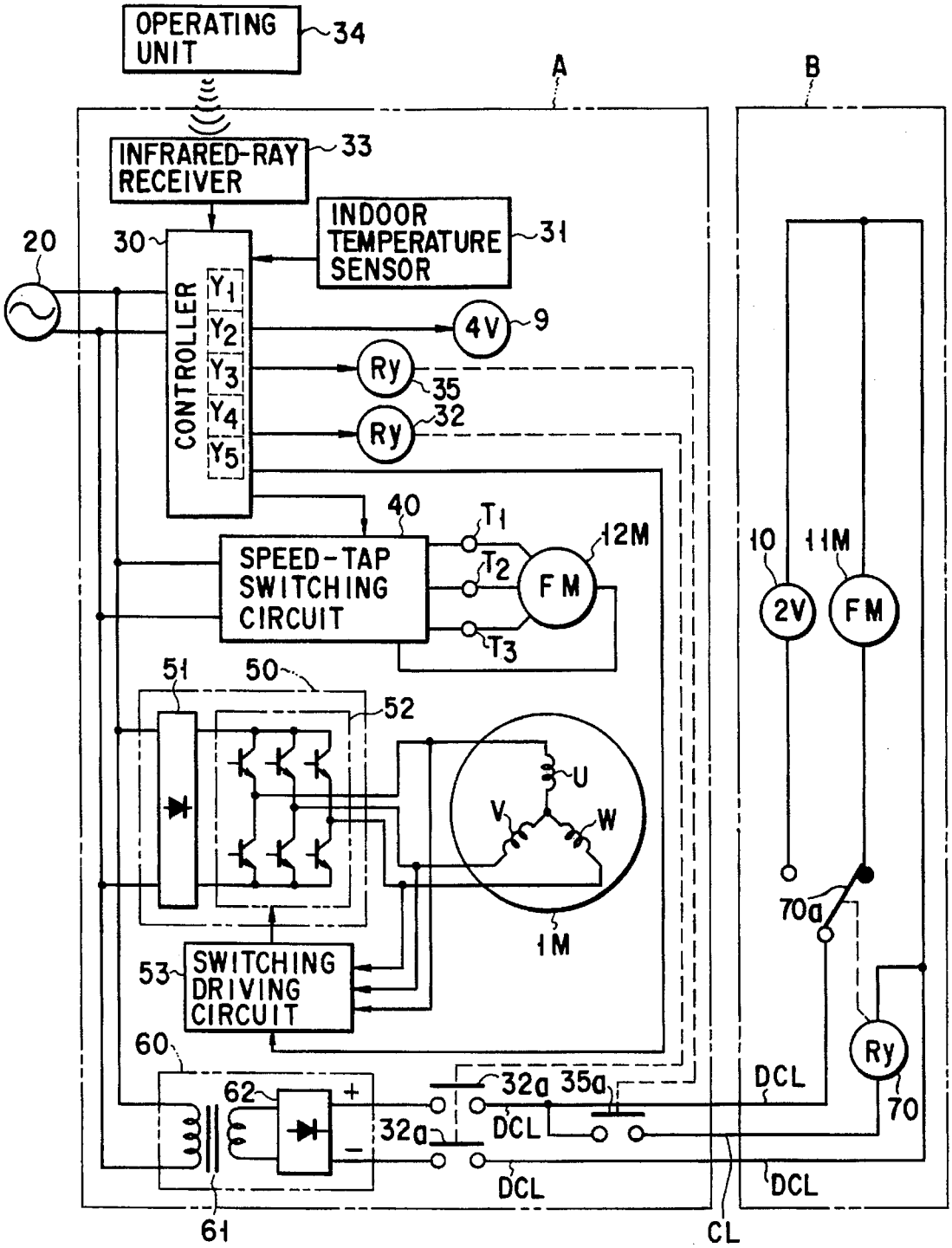
FIG. 4 is a block diagram showing the control circuit incorporated in the second embodiment.

The second embodiment of the invention, which is an air conditioner, too, will be described with reference to FIGS. 3 and 4. FIG. 3 shows the refrigerating cycle of the air conditioner, and FIG. 4 illustrates the control circuit incorporated therein. The components similar or identical to those shown in FIGS. 1 and 2 are designated at the same reference numerals in FIGS. 3 and 4 and will not be described in detail.

As shown in FIG. 3, the second embodiment comprises an indoor unit A and an outdoor unit B, too. It differs from the first embodiment in that the indoor unit incorporates a four-way valve 9 and that the outdoor unit B incorporates a two-way valve 10. The four-way vale 9 is provided on the pipes, one of which connects the compressor 1 and the outdoor heat exchanger 4 and the other of which connects the compressor 1 and the indoor heat exchanger 8. The two-way valve 10 is connected in parallel to the capillary tube 5, for bypassing the refrigerant in order to defrost the indoor heat exchanger 4.

The compressor 1, the outdoor heat exchanger 4, the capillary tube 5, the two-way valve 10, the indoor heat exchanger 8 and the four-way valve 9 constitute a heat-pump type refrigerating cycle.

The control circuit used in the second embodiment will be described, with reference to FIG. 4.

As shown in FIG. 4, the indoor unit A has a controller 30. The four-way valve 9 and two relays 32 and 35 are connected to the controller 30. As in the first embodiment, a DC power-supply lines DCL connects the indoor unit A and the outdoor unit B. More precisely, it is connected at one end to a DC power-supply lines DCL driving circuit 60 and at the other end to the outdoor unit B. The lines DCL consists of a positive line (+) and a negative line (−), on which two normal-open contacts 32*a* are provided. A control signal line CL is connected at one end to that portion of the positive line (+) which is located downstream of the contact 32*a*. The other end of the control signal line CL is connected to the outdoor unit B. A normal-open contact 35*a* is mounted on the line CL and is connected to the relay 35.

In the outdoor unit B, the control signal line CL is connected to the movable contact of a changeover switch 70*a*. The outdoor fan motor 11M is connected at one end to one of the stationary contacts of the switch 70*a*. The two-way valve 10 is connected at one end to the other stationary contact of the switch 70*a*. The other end of the motor 11M and the two-way valve 10 are connected to the negative line (−) of the DC power-supply lines DCL. Thus, the drive voltages of the outdoor fan motor 11M and the two-way valve 10, both provided in the outdoor unit B, are applied from the driving circuit 60 provided in the indoor unit A.

In the outdoor unit B, a relay 70 is connected at one end to the control signal line CL and at the other end to the negative line (−) of the DC power-supply lines DCL. The relay 70 has the changeover switch 70*a* described above and functions to conduct the voltage from the lines DCL to either the outdoor fan motor 11M or the two-way valve 10.

The controller 30 incorporated in the indoor unit A has the following five main components:

(1) A cooling control unit $Y_1$ in which the refrigerant discharged from the compressor 1 is supplied to the outdoor heat exchanger 4 through the four-way valve 9, to the capillary tube 5 and to the indoor heat exchanger 8, and is fed back to the compressor 1 through the four-way valve 9.

(2) A heating control unit $Y_2$ in which the refrigerant discharged from the compressor 1 is supplied to the indoor heat exchanger 8 through the four-way valve 9, to the capillary tube 5, and to the outdoor heat exchanger 4, and is fed back to the compressor 1 through the four-way valve 9.

(3) A defrosting control unit $Y_3$ in which the two-way valve 10 is opened during the heating operation, thereby to defrost the outdoor heat exchanger 4.

(4) A first control unit $Y_4$ which controls the relay 70 by supplying a control signal thereto through the controls signal line CL, so as to apply the voltage to the outdoor fan motor 11M when the cooling operation and heating operation.

(5) A second control unit $Y_5$ which controls the relay 70 by supplying a control signal thereto through the control signal line CL, so as to apply the voltage to the two-way valve 10 when the defrosting to the outdoor heat exchanger 4.

The operation of the air conditioner shown in FIGS. 3 and 4 will be described.

While the air conditioner is operated in cooling mode, the relay 32 is energized, whereas the relay 35 remains not energized. As a result, the normal-open contacts 32*a* of the relay 32 and provided on the positive and negative lines of the DC power-supply lines DCL are closed, and the normal-open contact 35*a* of the relay 35 and provided on the control signal line CL remain open. Connected to the positive line (+) and the control signal line CL, the relay 70 is de-energized and as its movable contact connected to the outdoor fan motor 11M. As a result, a voltage is supplied from the driving circuit 60 to the outdoor fan motor 11M, whereby the motor 11M is driven.

While the air conditioner is operated in heating mode, the controller 30 drives the four-way valve 9 such that the refrigerant discharged from the compressor 1 is supplied to the indoor heat exchanger 8 and hence to the outdoor heat exchanger 4 through the capillary tube 5, and is fed back to the compressor 1 through the four-way valve 9. Namely, the indoor heat exchanger 8 works as a condenser, whereas the outdoor heat exchanger 4 operates as an evaporator. In the heating operation mode, the relay 32 is energized, and the relay 35 is de-energized. Hence, the driving circuit 60 is electrically connected to the outdoor fan motor 11M as in the cooling operation mode. The motor 11M is therefore driven.

As the air conditioner heats the room, frost gradually develop on the surface of the outdoor heat exchanger 4. The heat-exchanging efficiency will decrease unless the heat exchanger 4 is defrosted. To prevent the heat-exchanging efficiency from decreasing, the outdoor heat exchanger 4 is defrosted at regular intervals or every time a specific condition is satisfied. More specifically, the controller 30 energizes the relay 35 at regular intervals or every time the temperature detected by a temperature sensor connected to the heat exchanger 4 falls below a preset value. When the relay 35 is energized, the contact 35*a* is closed, and the relay 70 provided in the outdoor unit B is energized. The movable contact of the changeover switch 70*a* is moved from the stationary contact connected to the outdoor fan motor 11M to the stationary contact connected to the two-way valve 10. As a result of this, the voltage is no longer supplied to the motor 11M, and is supplied to the two-way valve 10 instead.

The outdoor fan 11 is stopped. The two-way valve 10 is opened, bypassing the capillary tube 5. The indoor heat exchanger 8 is thereby connected directly to the outdoor heat exchanger 4. The refrigerant at a high temperature is therefore flows from the compressor 1 into the outdoor heat exchanger 4, hence to the indoor heat exchanger 8 through the two-way valve 10. The heat of the refrigerant is therefore used not only to heat the room but also to defrost the outdoor heat exchanger 4. Since the outdoor fan 11 is no longer driven, the defrosting efficiency is high.

Upon lapse of a predetermined time or when a condition for stopping defrosting is satisfied (for example, when the temperature sensor connected to the heat exchanger 4 rises above the a preset value), the relay 35 is de-energized, opening the contact 35*a*. The relay 70 in the outdoor unit A is thereby de-energized. The movable contact of the changeover switch 70*a* is moved from the stationary contact connected to the two-way valve 10 to the stationary contact connected to the outdoor fan motor 11M. As a result, the voltage is conducted to the motor 11M, and is no longer conducted to the two-way valve 10. Thus, the defrosting is terminated, and the ordinary heating operation is resumed.

As indicated above, the compressor 1, the four-way valve 9, and the driving circuit 60 for driving the two-way valve 10 and the outdoor fan motor 11M are provided in the indoor unit A. Electric components such as a transformer need not be incorporated in the outdoor unit B. Hence, the outdoor unit B can be made smaller than otherwise.

Further, the DC power-supply lines DCL can be connected to the outdoor unit B and the indoor unit A in safety. This is because the voltage applied from the driving circuit 60 provided in the indoor unit A to the outdoor fan motor 11M and the two-way valve 10, both provided in the outdoor unit B, is less than half the voltage of the commercial AC power supply 20. It suffices to connect only three lines, i.e., the positive (+) and negative (−) lines of the line DCL and the control signal line CL, between the indoor unit A and the outdoor unit B. Thus, the air conditioner can be installed by the user even if he or she has not been trained to install air conditioners.

No other current than the current for driving the outdoor fan motor 11M or the two-way valve 10 flows through the DC power-supply lines DCL, and the current for driving the motor 11M or the two-way valve 10 is small. The lines DCL are therefore one having a small diameter. Being thin, the lines DCL can easily be bent and twisted. This makes it easy to connect the indoor unit A and the outdoor unit B together.

The third embodiment of the invention, which is an air conditioner, too, will be described with reference to FIG. 5.

Figure 5:
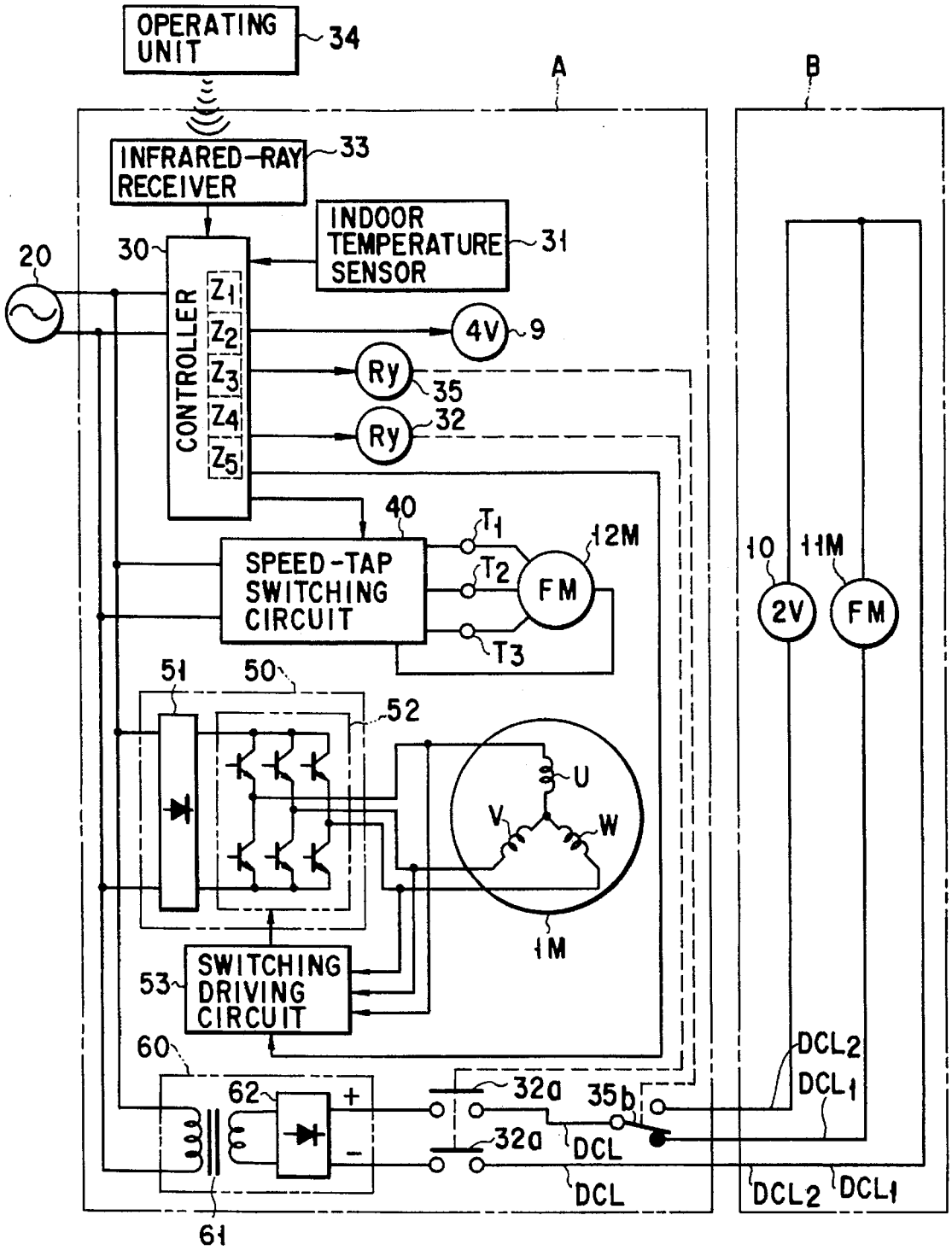
FIG. 5 is a block diagram showing the control circuit incorporated in the third embodiment.

As can be understood from FIG. 5, the third embodiment is identical to the second embodiment (FIG. 3), except that the control circuit differs in part.

As shown in FIG. 5, the relay 35 has the changeover switch 35*b*. The movable contact of the changeover switch 35*b* is connected to the positive line (+) of a DC power-supply lines DCL, which is located downstream of the contact 32*a*.

Two DC power-supply lines $DCL_1$ and $DCL_2$ extend from the indoor unit A into the outdoor unit B. The DC power-supply lines $DCL_1$ are connected a normal-closed stationary contact of the changeover switch 35*b*. The DC power-supply lines $DCL_2$ are connected a normal-open stationary contact of the changeover switch 35*b*. The negative line (−) in common with lines $DCL_1$ and lines $DCL_2$. The relay 35 have functions to conduct the voltage from the lines DCL to either the lines $DCL_1$ or the lines $DCL_2$. Hence, when the changeover switch 35*b* connects the movable contact to the normal-closed stationary contact, a voltage is applied from the driving circuit 60 to the outdoor unit B through the lines $DCL_1$. When the changeover switch 35*b* disconnects the movable contact from the normal-closed stationary contact and connects it to the normal-open stationary contact, the voltage is applied to the outdoor unit B through the lines $DCL_2$.

In the outdoor unit B, an outdoor fan motor 11M is connected to the power-supply lines $DCL_1$, and a two-way valve 10 is connected to the power-supply lines $DCL_2$.

The indoor unit A has a controller 30 as in the first and second embodiments. The controller 30 has the following five main components:

(1) A cooling control unit $Z_1$ in which the refrigerant discharged from the compressor 1 is supplied to the outdoor heat exchanger 4 through the four-way valve 9, the capillary tube 5 and the indoor heat exchanger 8, and is fed back to the compressor 1 through the four-way valve 9.

(2) A heating control unit $Z_2$ in which the refrigerant discharged from the compressor 1 is supplied to the indoor heat exchanger 8 through the four-way valve 9, to the capillary tube 5, and to the outdoor heat exchanger 4, and is fed back to the compressor 1 through the four-way valve 9.

(3) A defrosting control unit $Z_3$ in which the two-way valve 10 is opened during the heating operation, thereby to defrost the outdoor heat exchanger 4.

(4) A first control unit $Z_4$ which de-energizes the relay 35 when the cooling operation and heating operation, so as to apply the voltage from the driving circuit 60 to the outdoor fan motor 11M through the lines $DCL_1$.

(5) A second control unit $Z_5$ which energizes the relay 35 when the defrosting to the outdoor heat exchanger 4, so as to apply the voltage from the driving circuit 60 to the two-way valve 10 through the lines $DCL_2$.

The operation of the air conditioner shown in FIG. 5 will be described.

In the cooling operation and the heating operation, the controller 30 de-energizes the relay 35, whereby the voltage is applied from the driving circuit 60 to the outdoor fan motor 11M through the lines $DCL_1$.

During the heating operation, controller 30 energizes the relay 35 at regular intervals or when a condition for starting defrosting is satisfied. When energized, the relay 35 disconnects the power-supply lines $DCL_1$ from the driving circuit 60 and connects the power-supply lines $DCL_2$ to the driving circuit 60. As a result of this, the outdoor fan motor M11 is stopped, and the two-way valve 10 is opened. The capillary tube 5 is thereby bypassed, and the indoor heat exchanger 8 is thereby connected directly to the outdoor heat exchanger 4. The refrigerant at a high temperature is therefore flows from the compressor 1 into the outdoor heat exchanger 4, hence to the indoor heat exchanger 8 through the two-way valve 10. The heat of the refrigerant is therefore used not only to heat the room but also to defrost the outdoor heat exchanger 4. Since the outdoor fan 11 is no longer driven, the defrosting efficiency is high.

Upon lapse of a predetermined time or when a condition for stopping defrosting is satisfied (for example, when the temperature sensor connected to the heat exchanger 4 rises above the a preset value), the relay 35 is de-energized. The power-supply lines $DCL_2$ is disconnected from the driving circuit 60, and the power-supply lines $DCL_1$ is connected to the driving circuit 60. The outdoor fan motor 11M is therefor driven, while the two-way valve 10 is closed. Thus, the defrosting is terminated, and the ordinary heating operation is resumed.

As indicated above, the compressor 1, the four-way valve 9, and the driving circuit 60 for driving the two-way valve 10 and the outdoor fan motor 11M are provided in the indoor unit A. Electric components such as a transformer need not be incorporated in the outdoor unit B. Hence, the outdoor unit B can be made smaller than otherwise.

Further, the power-supply lines $DCL_1$ and $DCL_2$ can be connected to the outdoor unit B and the indoor unit A in safety. This is because the voltage applied through these lines $DCL_1$ and $DCL_2$ from the driving circuit 60 provided in the indoor unit A to the outdoor fan motor 11M and the two-way valve 10, both provided in the outdoor unit B, is less than half the voltage of the commercial AC power-supply 20. It suffices to connect only three lines, i.e., the lines $DCL_1$ and $DCL_2$, between the indoor unit A and the outdoor unit B. Thus, the air conditioner can be installed by the user even if he or she has not been trained to install air conditioners.

No other current than the current for driving the outdoor fan motor 11M or the two-way valve 10 flows through the power-supply lines $DCL_1$ and $DCL_2$, and the current for driving the motor 11M or the two-way valve 10 is small. The lines $DCL_1$ and $DCL_2$ are ones which have a small diameter. Being thin, the lines $DCL_1$ and $DCL_2$ can easily be bent and twisted. This makes it easy to connect the indoor unit A and the outdoor unit B together.

The present invention is not limited to the embodiments described above. Rather, various changes and modification can be made without departing from the scope of the invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An air-conditioning apparatus comprising:

an outdoor unit having an outdoor heat exchanger, an expansion device, and an outdoor fan for circulating outdoor air via said outdoor heat exchanger;

an indoor unit to be connected to a commercial AC power supply and having a compressor, an indoor heat exchanger, and an indoor fan circulating indoor air via said indoor heat exchanger;

a driving circuit provided in said indoor unit, for applying a voltage lower than a voltage applied from the commercial AC power supply, to drive said outdoor fan; and a power-supply line for applying the output voltage of the driving circuit to said outdoor unit.

wherein said compressor, said outdoor heat exchanger, said expansion device, and said indoor heat exchanger are connected by pipes, thereby constituting a refrigerating cycle.

2. An apparatus according to claim 1, further comprising cooling operation means for feeding a refrigerant discharged from said compressor, back to the compressor through said outdoor heat exchanger, said expansion device and said indoor heat exchanger, thereby to perform a cooling operation.

3. An air-conditioning apparatus comprising:

an outdoor unit having an outdoor heat exchanger, an expansion device, and an outdoor fan for circulating outdoor air via said outdoor heat exchanger;

an indoor unit to be connected to a commercial AC power supply and having a compressor, a four-way valve, an indoor heat exchanger, and an indoor fan circulating indoor air via said indoor heat exchanger;

a driving circuit provided in said indoor unit, for applying a voltage lower than a voltage applied from the commercial AC power supply, to drive said outdoor fan; and a power-supply line for applying the output voltage of the driving circuit to said outdoor unit.

wherein said compressor, said four-way valve, said outdoor heat exchanger, said expansion device, and said indoor heat exchanger are connected by pipes, thereby constituting a heat-pump type refrigerating cycle.

4. An apparatus according to claim 3, further comprising:

cooling operation means for feeding a refrigerant discharged from said compressor, back to the compressor through said four-way valve, said outdoor heat exchanger, said expansion device and said indoor heat exchanger, and again through the four-way valve, thereby to perform a cooling operation.

heating operation means for feeding the refrigerant discharged from said compressor, back to the compressor through said four-way valve, said indoor heat exchanger, said expansion device and said outdoor heat exchanger, and again through said four-way valve, thereby to perform a heating operation;

a two-way valve provided in said outdoor unit and connected in parallel to said expansion device; and defrosting means for opening said two-way valve during the heating operation, thereby to defrost said outdoor heat exchanger.

5. An apparatus according to claim 4, wherein said driving circuit outputs a voltage lower than the voltage applied from the commercial AC power supply, to drive said outdoor fan and said two-way valve.

6. An apparatus according to claim 5, further comprising:

switching means provided in said outdoor unit, for conducting the voltage from said power-supply line to said outdoor fan or said two-way valve;

a control signal line connected between said indoor unit and said outdoor unit;

first control means provided in said indoor unit, for controlling said switching means by supplying a control signal thereto through said control signal line, thereby to apply the voltage to said outdoor fan when the cooling operation and the heating operation; and second control means provided in said indoor unit, for controlling said switching means by supplying a control signal thereto through said control signal line, thereby to apply the voltage to said two-way valve when the defrosting to said outdoor heat exchanger.

7. An apparatus according to claim 5, wherein said power-supply line consists of a first power-supply line and a second power-supply line for applying the output voltage of said driving circuit to said outdoor fan and said two-way valve, respectively.

8. An apparatus according to claim 7, further comprising switching means provided in said indoor unit, for conducting the voltage through said first power-supply line or said second power-supply line;

first control means provided in said indoor unit, for controlling said switching means, thereby to apply the voltage through said first power-supply line when the cooling operation and the heating operation; and second control means provided in said indoor unit, for controlling said switching means, thereby to apply the voltage through said second power-supply line when the defrosting to said heat exchanger.

* * * * *